US006845526B2

(12) United States Patent
Malek et al.

(10) Patent No.: US 6,845,526 B2
(45) Date of Patent: Jan. 25, 2005

(54) PULLOUT SPRAY HEAD DOCKING COLLAR WITH ENHANCED RETAINING FORCE

(75) Inventors: Michael L. Malek, North Olmsted, OH (US); W. Randall Tucker, Oberlin, OH (US)

(73) Assignee: Moen Incorporated, North Olmsted, OH (US)

( * ) Notice: Subject to any disclaimer, the term of this patent is extended or adjusted under 35 U.S.C. 154(b) by 0 days.

(21) Appl. No.: 10/341,730

(22) Filed: Jan. 14, 2003

(65) Prior Publication Data

US 2004/0135009 A1 Jul. 15, 2004

(51) Int. Cl.[7] ..... E03C 1/04
(52) U.S. Cl. ..... 4/678; 4/675; 4/676; 4/615
(58) Field of Search ..... 4/678, 677, 676, 4/675, 615; 239/588, 587.1, 25, 24; 137/801, 798, 799; 285/305, 319, 320, 330, 417, 328, 332

(56) References Cited

U.S. PATENT DOCUMENTS 3,087,746 A * 4/1963 Hamilton et al. ..... 285/243
4,062,573 A * 12/1977 Fleischer ..... 285/116
6,672,628 B2 * 1/2004 Thomas et al. ..... 285/320

FOREIGN PATENT DOCUMENTS

DE 3138414 A1 * 4/1983
DE 3339849 A1 * 5/1985
EP 0486000 A1 * 5/1992

OTHER PUBLICATIONS

Grohh, Ladylux Plus 33 737 Pull–out Spray.

* cited by examiner

*Primary Examiner*—Gregory L. Huson
*Assistant Examiner*—Khoa D. Huynh
(74) *Attorney, Agent, or Firm*—Calfee, Halter & Griswold, LLP

(57) ABSTRACT

A faucet has a spout and a pullout spray head connected to a flexible water supply tube and releasably connectable to the spout. The spout has a docking collar mounted thereon for receiving a connecting shaft of the spray head. The docking collar has an annular wall with a plurality of U-shaped slots which define a plurality of cantilevered snap fingers. Each snap finger includes a projection that fits into a groove in the connecting shaft when the spray head is docked. An elastomeric O-ring surrounds the annular wall at a point where the O-ring engages the snap fingers to bias them toward the groove. Ridges on the exterior surface of the wall retain the O-ring in place. The spout and docked spray head have parallel shoulders that define a mating plane. The projections and groove define a retaining plane. The mating plane is not parallel to the retaining plane such that rotation of the spray head about an axis normal to the mating plane will cause the projections to release from the groove.

24 Claims, 2 Drawing Sheets

Fig. 3.
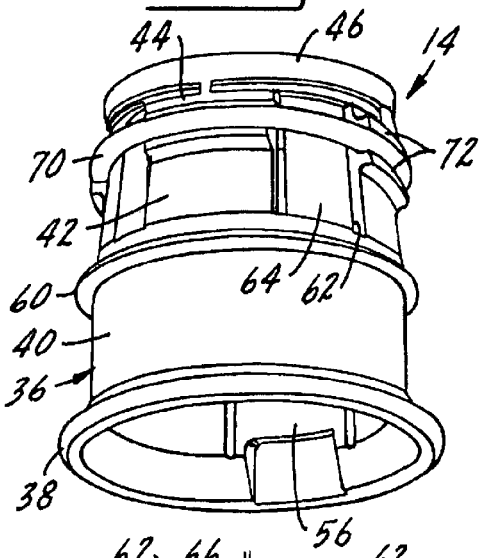
Fig. 4.
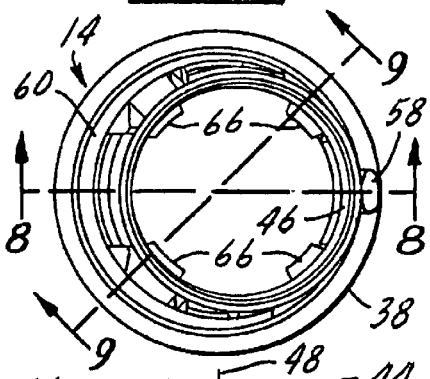
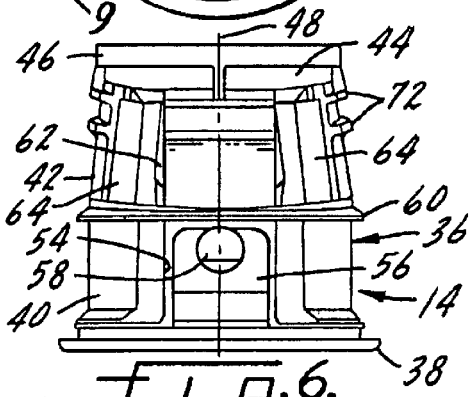
Fig. 6.
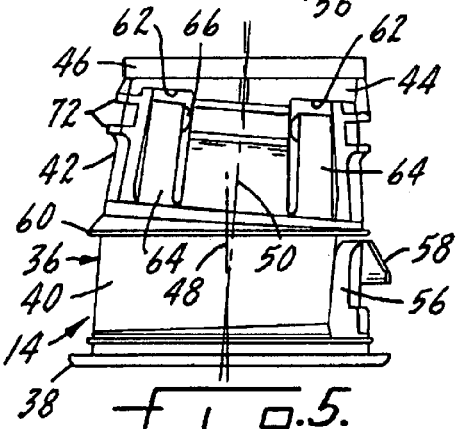
Fig. 5.
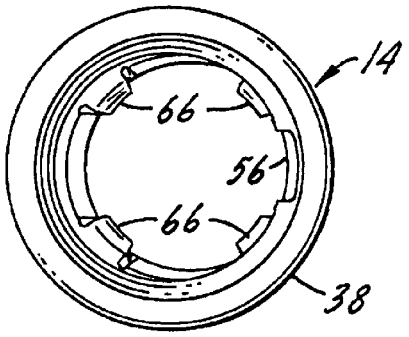
Fig. 7.
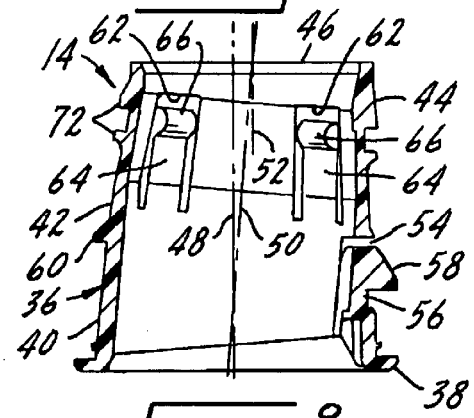
Fig. 8.
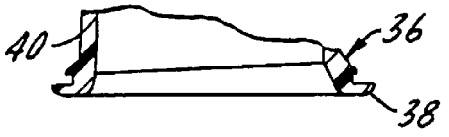
Fig. 9.

PULLOUT SPRAY HEAD DOCKING COLLAR WITH ENHANCED RETAINING FORCE

BACKGROUND OF THE INVENTION

This invention relates to faucets of the type having a pullout spray head and is particularly concerned with an improved docking collar. The docking collar is fixed at or near the end of a spout for mating with a pullout spray head or wand to releasably hold or mount the spray head to the spout. The docking collar of the prior art typically includes a plurality of cantilevered, flexible snap fingers which are engageable with recesses or the like in a portion of the pullout spray head which fits into the collar. The snap fingers of the prior art collar rely on the inherent resiliency of the plastic material of which the collar is made to produce a retaining force. This retaining force, while enough to hold the wand on the spout, can be overcome when a user wishes to release the wand from the spout. Release of the spray head is achieved by simply pulling outwardly or downwardly on the spray head until the snap fingers are forced to flex out of the mating recesses.

One problem with the snap finger arrangement of the prior art docking collar is the retention force is produced solely by the flexibility of the cantilevered fingers. That flexibility, and thus the retention force, can change over time as the material ages and as the number of dock-and-release cycles increases. This counsels a snap finger design that has a higher retention force than optimum at the outset of the product's life, with the expectation that the retention force will decline over time. The high initial retention force leads to higher stresses on the spout when the user has to overcome the retention force to pull out the spray head. This is a particular problem with high arc, gooseneck type spouts, such as in bar faucets and some kitchen faucets. Another difficulty with high initial retention force is the potential for creating a negative first impression on prospective purchasers of the faucet. Purchasers may try to release the wand from the spout in a floor sample faucet and decide not to purchase the faucet due to the perceived difficulty of undocking the wand. Still another problem with prior art snap finger designs is they are susceptible to fatigue failure.

SUMMARY OF THE INVENTION

The faucet of the present invention has an improved docking collar which is attached to the end of a spout. A pullout spray head is releasably connectable to the docking collar. The spray head is also connectable to a flexible water supply tube that extends through the spout. The docking collar has an annular wall with a plurality of U-shaped slots therein which define cantilevered snap fingers. An elastomeric O-ring surrounds the annular wall and engages the snap fingers to urge them radially inwardly toward a spray head retaining position. The exterior surface of the annular wall has a series of ridges which hold the O-ring in place. The snap fingers include projections which are engageable with a groove in the spray head. The projections define a retaining plane.

The spout has a first shoulder and there is a second shoulder formed on the spray head. The first and second shoulders are parallel to one another when the spray head is docked on the spout. The first shoulder defines a mating plane. The spray head further includes a connecting shaft having a groove formed therein. The connecting shaft fits into the annular wall of the docking collar, with the snap finger projections extending into and engaging the groove when the spray head is docked. The retaining plane and the mating plane are not parallel to one another. Preferably, the two planes are angled at about 5° to one another. Thus, the retaining plane is inclined with respect to the mating plane. Twisting the spout creates a mechanical advantage as the shoulders engage one another and cause the connecting shaft to rotate the groove out of engagement with the snap finger projections.

One of the advantages of the present invention is the O-ring provides an inexpensive way to increase the retention force. Further, the retention force can easily be adjusted by selecting an appropriately sized O-ring. The O-ring makes the snap fingers much less susceptible to fatigue failure or diminution of the retention force over time. The retaining force remains consistent over time. The retaining force assistance provided by the O-ring can be applied at any point along the snap fingers, including directly adjacent the projections or other contact point of the fingers.

A further advantage of the invention is the small twist needed to undock the spray head greatly reduces the effort and force required to release the spray head. The mechanical advantage provided by the inclined plane allows a relatively high spray head retention force without causing the user to expend unusually high effort to undock the spray head. This in turn reduces the force required to undock the spray head or wand with the result that the stress on the spout is reduced as well.

BRIEF DESCRIPTION OF THE DRAWINGS

FIG. 3 is an enlarged perspective view of the docking collar according to the present invention.

FIG. 4 is a top plan view of the docking collar.

FIG. 5 is side elevation view of the docking collar.

FIG. 6 is front elevation view of the docking collar.

FIG. 7 is a bottom plan view of the docking collar.

FIG. 8 is a section taken along line 8—8 of FIG. 4.

FIG. 9 is a section taken along line 9—9 of FIG. 4.

DETAILED DESCRIPTION OF THE INVENTION

Figure 1:
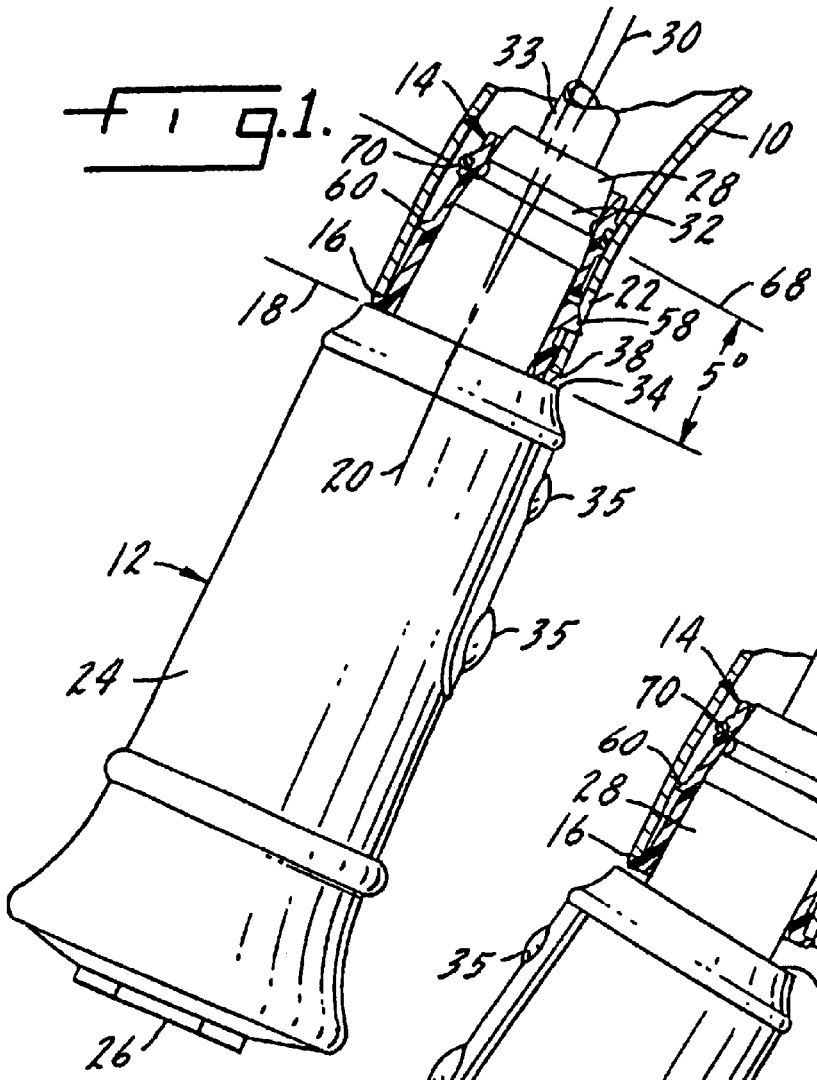
FIG. 1 is a side elevation view of an end portion of a faucet having pullout spray head mounted or docked thereto in accordance with the present invention, with portions in section.
Figure 2:
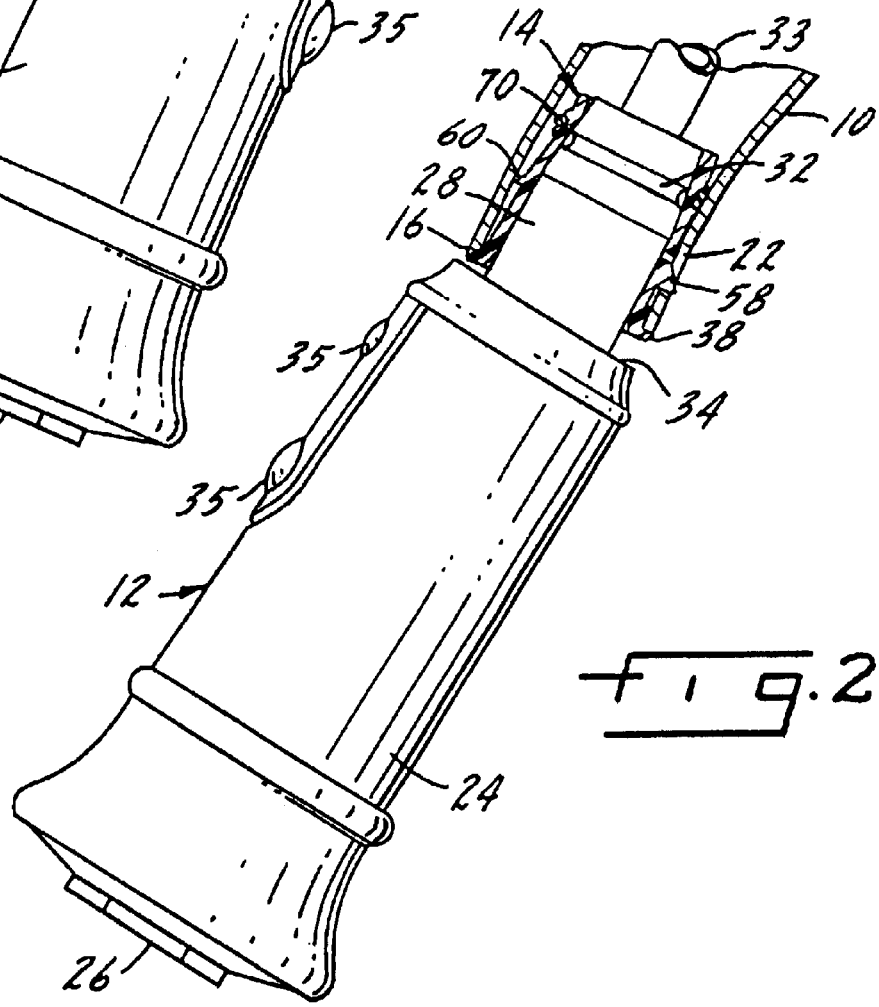
FIG. 2 is a view similar to FIG. 1 but with the pullout spray head twisted 180° from the normal docked position.

FIGS. 1 and 2 illustrate the major components of the faucet of the present invention. These include a spout 10, a pullout spray head or wand 12 and a docking collar 14. The spout 10 is a hollow, tubular member having a base, not shown, mounted on a suitable deck. The free end of the spout defines a first shoulder 16. The shoulder defines a mating plane indicated by line 18 in FIG. 1. The spout opening defines a primary axis as shown at line 20. The primary axis is normal to the mating plane. Spaced somewhat from the first shoulder 16 is an aperture 22. This aperture receives a retainer finger on the docking collar, as will be described below.

Turning now to the features of the spray head or wand 12, it includes a main body 24 which has a water discharge nozzle 26 at one end. The other end of the spray head has a male portion in the form of a hollow connecting shaft 28. The connecting shaft is generally cylindrical, although the free end may be somewhat tapered. The connecting shaft 28 defines a secondary axis as indicated by the line 30. A groove 32 or depression encircles the outer surface of the connecting shaft. The connecting shaft 28 is adapted for connection to a flexible water supply tube or conduit or hose, a portion of which is shown schematically at 33 in FIG. 1. A suitable clamp, washer or the like may be added to hold the tube in the connecting shaft. It will be understood that the water supply tube extends through the hollow spout 10 to a water control valve which is in turn connected to suitable water supply lines. As is conventional the water supply tube 33 has a length which allows the spray head 12 to be pulled off of the spout 10 and extended therefrom so that a user can point the nozzle 26 as needed to direct water in any desired direction. The junction between the main body 24 and the connecting shaft 28 forms a second shoulder 34, as best seen in FIG. 2. It will be noted that the secondary axis 30 is not perpendicular to the second shoulder 34. A set of pushbutton controls 35 are provided on one side of the main body. Further details of the spray head's construction are shown and described in U.S. patent application Ser. Nos. 10/291,157 and 10/291,131, both filed Nov. 8, 2002, the disclosures of which are incorporated herein by reference.

Details of the docking collar 14 are shown in FIGS. 3–9. The collar has a female portion defined by a body shown generally at 36. The body includes an annular wall made up of a base rim 38, a lower portion 40, a frusto-conical portion 42, an upper portion 44 and an upper rim 46. It will be noted, particularly in FIG. 8, that the base rim 38 defines and is normal to a first axis 48 while the lower portion 40 and frusto-conical portion 42 of the annular wall define a second axis 50 that is angled 5° from the first axis. The upper portion is angled with respect to the frusto-conical portion such that the upper portion defines a third axis 52 that is parallel to and slightly spaced from the first axis 48. As best seen in FIG. 5, the upper portion 44 has a wedge shape with a greater height on the side of the retainer finger 56 than on the opposite side. In fact, the upper portion 44 nearly disappears opposite the retainer finger 56 as the frusto-conical portion 42 essentially joins the upper rim 46 directly. As a result of this structure with the oppositely-angled upper and lower portions the upper rim 46 is parallel to the base rim 38, even though the lower portion and frusto-conical portions are angled with respect to the base rim.

The lower portion 40 of the annular wall has a cutout 54 that defines a retainer finger 56. An angled prong 58 extends radially outwardly from the free end of the finger 56 and is engageable with the aperture 22 of the spout to hold the collar in the end of the spout. In addition to the prong 58, the external surface of the docking collar includes an eccentric centering flange 60 at the junction of the exterior surfaces of the lower portion 40 and frusto-conical portion 42. The centering flange is shaped to fill the gap between the exterior of the docking collar and the internal wall of the spout. The collar 14 is inserted into the end of the spout 10. The retainer finger 56 flexes to allow the prong 58 to slip past the shoulder 16 and into the aperture 22. When the collar is fully inserted the prong 58 engages the aperture 22, the base rim 38 engages the first shoulder 16, and the centering flange 60 engages the internal wall of the spout. This substantially fixes the docking collar 14 in the spout 10.

The frusto-conical portion 42 has a plurality of U-shaped cutouts or slots 62. Each cutout defines a cantilevered snap finger 64. The snap fingers will flex radially. The interior face of each snap finger has a projection 66. The projections define a retaining plane as shown by line 68 in FIG. 1. The retaining plane 68 is perpendicular to the second axis 50. The projections are arranged such that they will engage the groove 32 when the connecting shaft 28 is inserted into the docking collar and oriented for docking.

A biasing means or member urges the snap fingers radially inwardly. In a preferred embodiment the biasing means is an elastomeric O-ring 70, which is best seen in FIG. 3. The exterior surface of the frusto-conical portion 42 has a plurality of ridges 72 which form channels for holding the O-ring in place. The ridges are located such that the O-ring crosses over the snap fingers, preferably right behind the projections 66. Accordingly, the O-ring enhances the retaining force with which the snap fingers engage the groove. The retaining force can be adjusted by selecting an appropriately sized O-ring.

The use, operation and function of the invention are as follows. The docking collar 14 is shown in FIG. 1 attached to the spout 10. The first axis 48 of the docking collar is substantially coincident with the primary axis 20 of the spout. The wand 12 is shown in its docked position wherein the secondary axis 30 of the connecting shaft is parallel to the second axis 50 of the collar. The groove 32 is aligned with the retaining plane 68 such that the projections 66 of the snap fingers 64 engage the groove 32 of connecting shaft 28 of the wand. The second shoulder 34 is parallel to the first shoulder 16. The second shoulder of the wand is in abutting relation with the collar's base rim 38, or close to it. The pushbutton are aligned with the retainer finger 56.

To release the pullout spray head from the docking collar, a user twists the main body 24 in either direction. Due to engagement of the wand shoulder 34 and the base rim 38 of the collar, the wand rotates about the primary axis 20. The connecting shaft axis 30, being angled with respect to axis 20, is going to precess about axis 20. Thus, axis 30 will move out of alignment with the second axis 50 of the collar. As it does so the groove 32 will move out of alignment with the retaining plane. The snap fingers 64 will flex outwardly and allow the projections 66 to slip out of the now non-aligned groove. One side of the second shoulder 34 remains in contact with the base rim. As a result of this engagement, rotation of the main body tends to pull the wand down and out of the spout, as shown in FIG. 2. The groove is forced to move away from the snap finger projections along a helical path.

Another way to look at the motion derived from the inclined mating and retaining planes is to note in FIG. 1 that the distance between the planes at the retaining finger 56 side of the collar is less than that at the opposite side of the collar. Similarly, on the wand the distance between the shoulder 34 and the groove 32 is less on the pushbutton side than on the opposite side of the connecting shaft. When the wand is docked these differential distance relationships coincide and the snap finger projections line up with the groove. When the wand is rotated 180° or so from the docked position, the short shoulder-to-groove distance on the connecting shaft is aligned with the long base rim-to-retaining plane distance on the collar. That mismatch, which gradually arises and increases as the wand is rotated away from its docked position, causes the groove to pull out of engagement with the snap fingers. The snap fingers flex outwardly as the connecting shaft pulls down and out of the spout. The mechanical advantage supplied by the inclined mating and retaining planes allows the user to release the wand with a simple rotating motion which overcomes a relatively high retaining force applied by the O-ring.

While a preferred form of the invention has been shown and described, it will be realized that alterations and modifications may be made thereto without departing from the scope of the following claims. For example, while the biasing means acting on the snap fingers is shown as an O-ring, it could be some other spring-like arrangement acting on the snap fingers. A plurality of leaf springs, one spring associated with each snap finger, attached to the annular wall is one possibility. Or a series of leaf springs mounted on the interior surface of the spout might act against the exterior of the snap fingers. Obviously the number of snap fingers could be other than as shown.

We claim:

1. A faucet, comprising:

a spout;

a pullout spray head connectable to a water supply conduit and releasably connectable to the spout;

one of the spout and spray head having a male portion and the other having a female portion, said male and female portions interfitting in telescoping relation to releasably connect the pullout spray head to the spout;

at least one snap finger flexibly connected to one of said male and female portions and disposed to be engagable with the other of said portions; and means for engaging the snap finger to urge it toward a position where the snap finger engages the other of said male and female portions.

2. The faucet of claim 1 wherein the female portion comprises a docking collar attached to one of the spout or pullout spray head, the docking collar comprising a body, with the snap finger being flexibly connected to the body and disposed to be engagable with the male portion, and means for engaging surrounds the body to urge the snap finger toward the position where the snap finger engages the male portion.

3. The faucet of claim 2 wherein the body has an annular wall and the snap finger is defined by a U-shaped slot which extends through the wall.

4. The faucet of claim 3 wherein means for engaging has a first portion engagable with the annular wall and a second portion spanning the U-shaped slot to engage the snap finger.

5. The faucet of claim 3 wherein means for engaging comprises an O-ring surrounding the annular wall and engaging the snap finger.

6. The faucet of claim 5 further comprising at least one pair of spaced ridges on the annular wall, the ridges defining a channel in which the O-ring is disposed.

7. The faucet of claim 2 wherein the body has an annular wall and a plurality of snap fingers attached to said wall, and means for engaging comprises an O-ring surrounding and engaging the snap fingers.

8. The faucet of claim 1 wherein the snap finger has a projection thereon and the other of said portions has a recess into which the projection releasably fits.

9. The faucet of claim 1 wherein the snap finger is formed on the female portion and is biased toward the male portion.

10. A faucet, comprising:

a spout;

a pullout spray head which is releasably connectable to the spout;

a docking collar attached to one of the spout or pullout spray head, the docking collar comprising a body, at least one snap finger flexibly connected to the body and disposed to be engagable with the other of the spout or pullout spray head, and means for engaging the snap finger to urge it toward a position where the snap finger engages the other of the spout or pullout spray head.

11. The faucet of claim 10 wherein the body has an annular wall and the snap finger is defined by a U-shaped slot which extends through the wall.

12. The faucet of claim 11 wherein means for engaging has a first portion engagable with the annular wall and a second portion spanning the U-shaped slot to engage the snap finger.

13. The faucet of claim 11 wherein means for engaging comprises an O-ring surrounding the annular wall and engaging the snap finger.

14. The faucet of claim 13 further comprising at least one pair of spaced ridges on the annular wall, the ridges defining a channel in which the O-ring is disposed.

15. The faucet of claim 10 wherein the body has an annular wall and a plurality of snap fingers attached to said wall, and means for engaging comprises an O-ring surrounding and engaging the snap fingers.

16. The faucet of claim 10 wherein the snap finger has a projection thereon and the other of the spout or pullout spray head has a recess into which the projection releasably fits.

17. In a faucet of the type having a spout and a pullout spray head which is releasably connectable to the spout, the improvement comprising a docking collar attached to one of the spout or pullout spray head, the docking collar comprising:

a body;

at least one snap finger flexibly connected to the body and disposed to be engagable with the other of the spout or pullout spray head;

means for engaging the snap finger to urge it toward a position where the snap finger engages the other of the spout or pullout spray head.

18. The docking collar of claim 17 further comprising a retainer finger flexibly connected to the body and disposed to be engagable with said one of the spout or pullout spray head.

19. A faucet, comprising:

a spout;

a pullout spray head connectable to a water supply conduit and releasably connectable to the spout;

one of the spout and spray head having a male portion and the other having a female portion, said male and female portions interfitting in telescoping relation to releasably connect the pullout spray head to the spout;

at least one snap finger flexibly connected to the female portion and disposed to be engagable with the male portion; and biasing means engaging the snap finger to urge it toward a position where the snap finger engages the said male portion, wherein the female portion comprises a docking collar attached to one of the spout or pullout spray head, the docking collar comprising a body, with the snap finger being flexibly connected to the body and disposed to be engagable with the male portion, and the biasing means surrounds the body to urge the snap finger toward the position where the snap finger engages the male portion.

20. The faucet of claim 19 wherein the body has an annular wall and the snap finger is defined by a U-shaped slot which extends through the wall.

21. The faucet of claim 20 wherein the biasing means comprises an O-ring surrounding the annular wall and engaging the snap finger.

22. A faucet, comprising:

a spout;

a pullout spray head which is releasably connectable to the spout; and a docking collar attached to one of the spout or pullout spray head, the docking collar comprising a body, at least one snap finger flexibly connected to the body and disposed to be engagable with the other of the spout or pullout spray head, and biasing means engaging the snap finger to urge it toward a position where the snap finger engages the other of the spout or pullout spray head, wherein the body has an annular wall and the snap finger is defined by a U-shaped slot which extends through the wall and the biasing means comprises an O-ring surrounding the annular wall and engaging the snap finger.

23. A faucet, comprising:

a spout;

a pullout spray head connectable to a water supply conduit and releasably connectable to the spout;

one of the spout and spray head having a male portion and the other having a female portion, said male and female portions interfitting in telescoping relation with one another to releasably connect the pullout spray head to the spout;

at least one snap finger flexibly connected to one of said male and female portions and disposed to be engagable with the other of said portions; and a biasing member disposed on the one of said male and female portions, engaging the snap finger to urge it radially inward toward a position where the snap finger engages the other of said male and female portions.

24. In a faucet of the type having a spout and a pullout spray head which is releasably connectable to the spout, the improvement comprising a docking collar attached to one of the spout or pullout spray head, the docking collar comprising:

a body;

at least one snap finger flexibly connected to the body and disposed to be engagable with the other of the spout or pullout spray head; and a biasing member, disposed on the docking collar, engaging the snap finger to urge it radially inward toward a position where the snap finger engages the other of the spout or pullout spray head.

* * * * *